US005520364A

United States Patent [19]

Bloxson et al.

[11] Patent Number: 5,520,364

[45] Date of Patent: May 28, 1996

[54] DETACHABLE WEIGHT ASSEMBLY, AND COVER FOR USE IN COMBINATION WITH A DETACHABLE WEIGHT ASSEMBLY

[76] Inventors: Shawn E. Bloxson, 10621 S. Hampton Dr.; Gregory M. Rodriguez, 9107 Shackleford Ter., both of Charlotte, N.C. 28227

[21] Appl. No.: 283,397

[22] Filed: Jul. 29, 1994

[51] Int. Cl.[6] ..... A47G 9/06

[52] U.S. Cl. ..... 248/500; 5/417; 248/910

[58] Field of Search ..... 248/500, 505, 248/508, 510, 910; 5/417; 135/118, 122; 383/102

[56] References Cited

U.S. PATENT DOCUMENTS

| | | | |
|---|---|---|---|
| 3,226,737 | 1/1966 | Rote . | |
| 3,241,202 | 3/1966 | Knauft | 5/417 X |
| 3,935,653 | 2/1976 | Klein . | |
| 4,223,056 | 9/1980 | Di Fronzo . | |
| 4,277,864 | 7/1981 | Orson, Sr. | 40/1.5 X |
| 4,499,133 | 2/1985 | Prince . | |
| 4,654,906 | 4/1987 | Roberts . | |
| 4,927,118 | 5/1990 | Pierorazio . | |
| 5,018,229 | 5/1991 | Eberhart . | |
| 5,110,219 | 5/1992 | Lopes | 5/417 X |
| 5,141,200 | 8/1992 | Sherman et al. | 248/500 |
| 5,150,485 | 9/1992 | Maguire | 5/417 |
| 5,245,715 | 9/1993 | Dinkins | 248/508 X |
| 5,406,659 | 4/1995 | Camp | 5/417 |

*Primary Examiner*—Ramon O. Ramirez
*Assistant Examiner*—Derek J. Berger
*Attorney, Agent, or Firm*—W. Thad Adams, III

[57] ABSTRACT

A detachable weight assembly holds a cover in a desired position solely by gravity. The weight assembly includes a weight sufficiently heavy to immobilize the cover by gravity. A fastener is secured to the weight, and includes a spring-loaded clip for releasably attaching the weight to the cover.

9 Claims, 5 Drawing Sheets

DETACHABLE WEIGHT ASSEMBLY, AND COVER FOR USE IN COMBINATION WITH A DETACHABLE WEIGHT ASSEMBLY

TECHNICAL FIELD AND BACKGROUND OF THE INVENTION

This invention relates to a detachable weight assembly, and cover for use in combination with a detachable weight assembly. The weight assembly of the present invention is especially applicable to covers such as, beach towels, equipment covers, picnic blankets, car and boat covers, nursery ground covers, and the like. The invention attaches along the edges of the cover, and serves to immobilize the cover in a desired position solely by the effect of gravity.

Ground securing devices for use with covers, such as beach towels, are generally known the art. According to one prior art device, a rigid peg or stake is attached to each of the corners of a beach towel and driven into the ground or sand to hold the towel in a spread out condition.

This device, and similar devices requiring ground penetration, suffer from many drawback and limitations. For example, the prior art device is almost useless when the towel is laid upon a wooden sun deck or concrete pool side. Moreover, sun bathers often prefer using lounge chairs when at the beach or the pool. In this case, use of a ground-penetrating device is awkward and generally ineffective for holding the towel in a fixed position over the chair. In addition, many prior art devices are typically long and pointed, and may cause injury if stepped upon or tripped over. This problem is especially prevalent at the beach, since the device is readily hidden in the sand.

The present invention overcomes these and other problems of the prior art by providing a detachable, cover-immobilizing weight assembly which does not require penetration of the ground surface. The invention can be easily attached to a cover and suspended from an edge of the cover above the ground surface, or laid directly upon the ground surface. For example, the invention may be attached to bed sheets or other laundry hung from a clothes line to prevent the laundry from blowing off the clothes line. The invention is useful in combination with any type of cover for immobilizing the cover regardless of the nature of the ground surface or supporting surface.

In the case of a beach towel, the weight of the present invention is quickly and easily increased by dipping the weight assembly in water. The invention can be stepped upon without injury. Moreover, the invention is relatively small and convenient for transport to and from the beach.

SUMMARY OF THE INVENTION

Therefore, it is an object of the invention to provide a detachable weight assembly for being attached to a cover to immobilize the cover solely by the effect of gravity.

It is another object of the invention to provide a detachable weight assembly which is relatively inexpensive.

It is another object of the invention to provide a detachable weight assembly which can be safely used in combination with a beach towel to hold the beach towel in a spread condition on the beach.

It is another object of the invention to provide a detachable weight assembly which can be safely used in combination with a beach towel to hold the beach towel in a spread condition over a lounge chair.

It is another object of the invention to provide a detachable weight assembly for use in combination with an equipment cover for immobilizing the cover over a desired piece of equipment.

It is another object of the invention to provide a detachable weight assembly which includes a weight bag filled with sand, and which can be made heavier by dipping the weight bag in water.

It is another object of the invention to provide a cover for use in combination with one or more detachable weight assemblies.

These and other objects of the present invention are achieved in the preferred embodiments disclosed below by providing a detachable weight assembly for holding a cover in a desired position solely by gravity. The weight assembly includes a weight sufficiently heavy to immobilize the cover by gravity. A fastener is secured to the weight, and includes attachment means for releasably attaching the weight to the cover.

According to one preferred embodiment of the invention, the weight is a weight bag filled with sand.

According to another preferred embodiment of the invention, the weight bag is water permeable.

According to yet another preferred embodiment of the invention, the weight bag is constructed of a quick-drying, nylon cloth.

According to yet another preferred embodiment of the invention, the weight bag contains between 4–8 oz. of dry sand.

According to yet another preferred embodiment of the invention, the attachment means of the fastener is a spring-loaded clip.

According to yet another preferred embodiment of the invention, a reinforced opening is formed in the weight bag. The fastener includes an elongate strip passed through the opening and folded. The strip includes snap means for releasably securing the fastener to the weight bag.

According to yet another preferred embodiment of the invention, the reinforced opening includes a rust-resistant metal grommet.

According to yet another preferred embodiment of the invention, the weight bag is triangular with the fastener being secured at one corner thereof.

According to yet another preferred embodiment of the invention, the weight bag is square.

According to yet another preferred embodiment of the invention, the weight bag is diamond-shaped.

According to yet another preferred embodiment of the invention, the weight bag is circular.

A cover is provided for use in combination with a plurality of weight assemblies. The weight assemblies are removably attached in spaced-apart relation along the perimeter edges of the cover for holding the cover in a desired position solely by gravity.

According to one preferred embodiment of the invention, the cover is a beach towel for being spread out on the beach or over a lounge chair.

According to another preferred embodiment of the invention, the cover is a protective, equipment cover.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
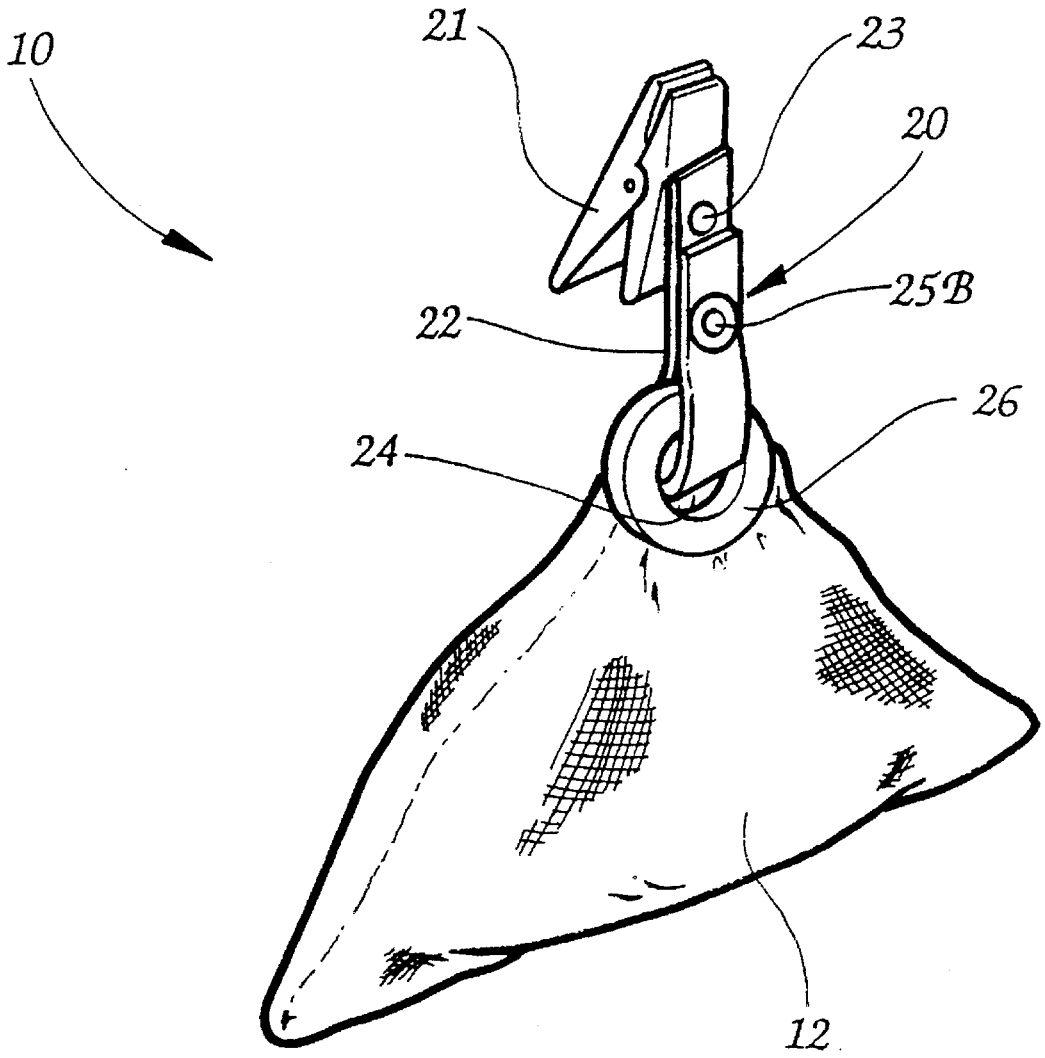
FIG. 1 is a perspective view of a detachable weight assembly according to a preferred embodiment of the invention.

Referring now specifically to the drawings, a single weight assembly according to the present invention is illustrated in FIG. 1 and shown generally at reference numeral 10. The weight assembly 10 is used in combination with a cover 11 (See FIGS. 2 and 3) for holding the cover 11 in a desired position solely by gravity.

Figure 2:
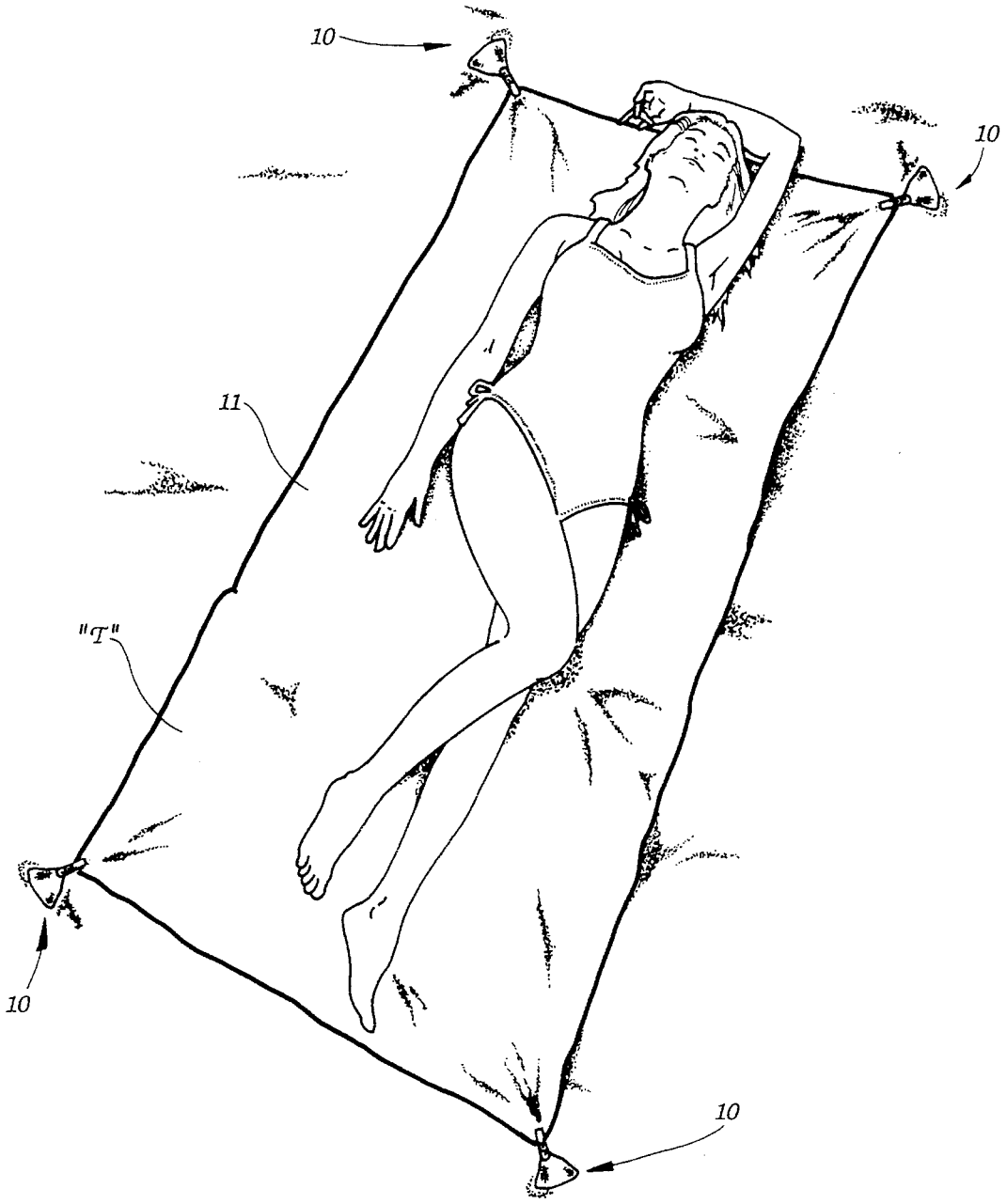
FIG. 2 is a perspective view of a beach towel and sun bather, showing a plurality of weight assemblies attached to respective corners of the beach towel.

FIG. 2 illustrates one application of the weight assembly 10 to a cover 11, such as a beach towel "T". As shown, a single weight assembly 10 is preferably attached to each corner of the beach towel "T" to hold the beach towel "T" in a spread out condition. The plurality of weight assemblies 10 cooperate to anchor the towel "T" by gravity, and to prevent the towel "T" from being blown away or wrinkled due to windy conditions generally present at the beach.

Alternatively, the beach towel "T" may be laid over a lounge chair (not shown) with the weight assemblies 10 attached along the perimeter edges of the towel "T". Since the weight assemblies 10 are not driven into the ground, they may rest freely on the ground surface near the chair, or may be suspended from the edge of the towel "T" above the ground surface. In either case, the weight assemblies 10 cooperate to effectively hold the towel "T" over the lounge chair, and to prevent the towel "T" from being blown away or folded.

Figure 3:
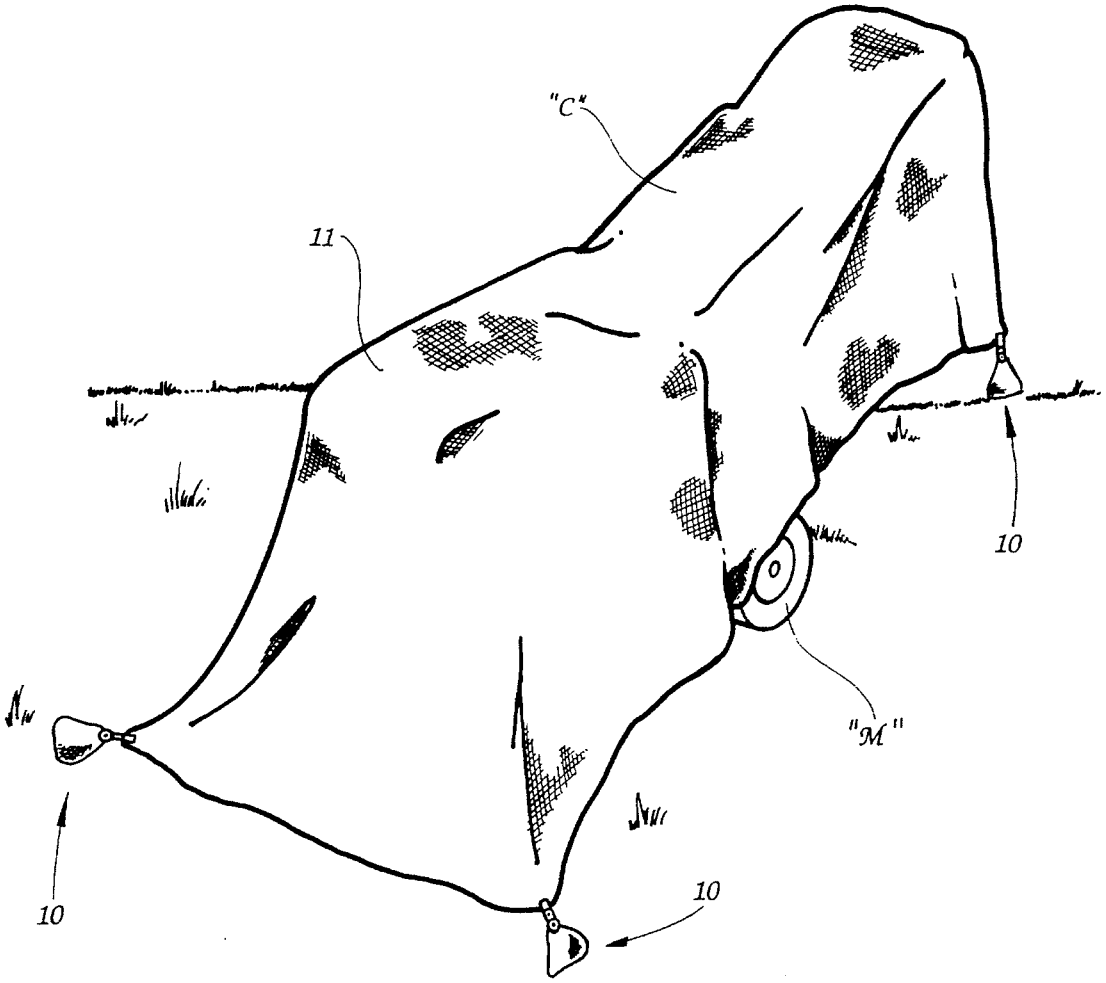
FIG. 3 is a perspective view of an equipment cover with a plurality of weight assemblies attached thereto, and showing the equipment cover laid over a lawn mower.

As shown in FIG. 3, the weight assemblies 10 may also be applied to a cover 11, such as an equipment cover "C" for covering and protecting items which are typically stored outdoors. The equipment cover "C" illustrated in FIG. 3 is shown covering a lawn mover "M". Two or more weight assemblies 10 are preferably attached along the perimeter edges of the equipment cover "C" to hold the cover "C" over the lawn mower "M" .

According to one preferred embodiment, each weight assembly 10 includes a 100% nylon cloth bag 12 (See FIG. 1) filled with about 4–8 ounces of dry, white sand. The bag 12 is preferably water permeable. Thus, the weight of the bag 12 is easily and quickly increased to between 6–12 ounces by dipping the bag 12 in water to wet the sand. According to another preferred embodiment, the bag 12 is constructed of a durable, cellophane material, and may be filled with other weighting objects, such as lead pellets.

The weight of the bag 12 may be increased, as desired, by increasing the size of the bag 12 and adding sand or other weighting objects. For example, to secure a relatively large and heavy cover 11, such as a boat cover (not shown), two or more larger and heavier bags 12 may be used.

Figure 4:
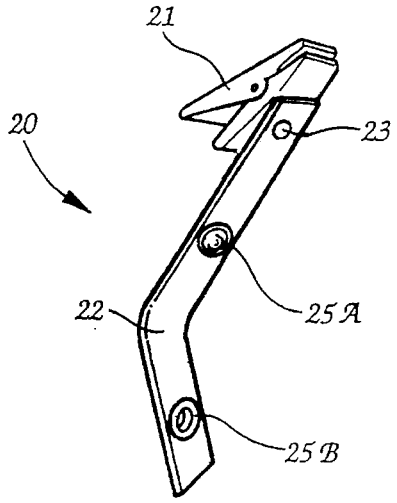
FIG. 4 is a perspective view of the fastener for releasably attaching the weight assembly to the cover.
Figure 5:
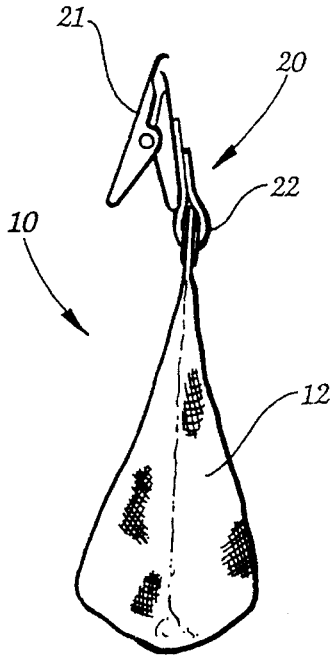
FIG. 5 is a side view of the weight assembly according to a preferred embodiment.

Referring to FIGS. 1, 4, and 5, a fastener 20 is secured to the weight bag 12, and serves to releasably attach the weight bag 12 to the edges of the cover 11. As best shown in FIG. 4, the fastener 20 includes a spring-loaded clip 21, and an elongate strip 22 of flexible plastic attached to the clip 21 by a rivet 23. The free end of the strip 22 is passed through a reinforced opening 24 formed in the weight bag 12. The strip 22 is then folded, and removably secured to the weight bag 12 by complementary male and female snaps 25A and 25B. Preferably, the reinforced opening 24 of the weight bag 12 includes a rust-resistant, metal grommet 26.

The clip 21 preferably does not damage the material of the cover 11 when attached and detached. In one preferred embodiment, the clip 21 is identical to that commonly used with identification tags or badges. In another preferred embodiment, the clip 21 is an alligator clip.

Figure 6:
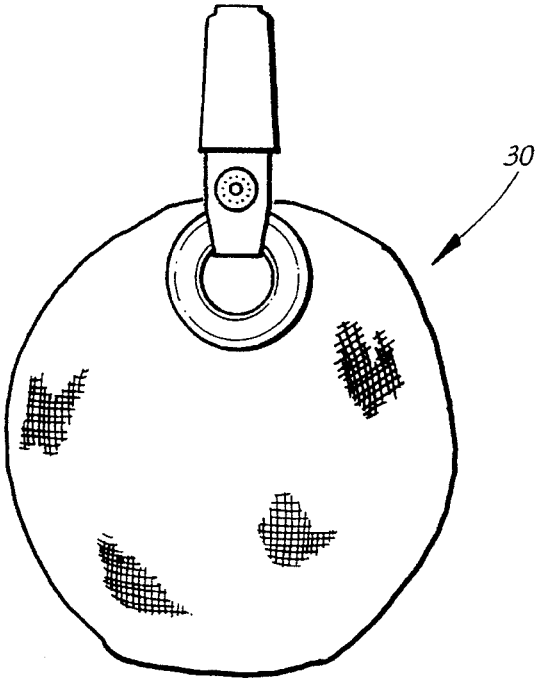
FIG. 6 is a front elevation of a weight assembly according to a second preferred embodiment.
Figure 7:
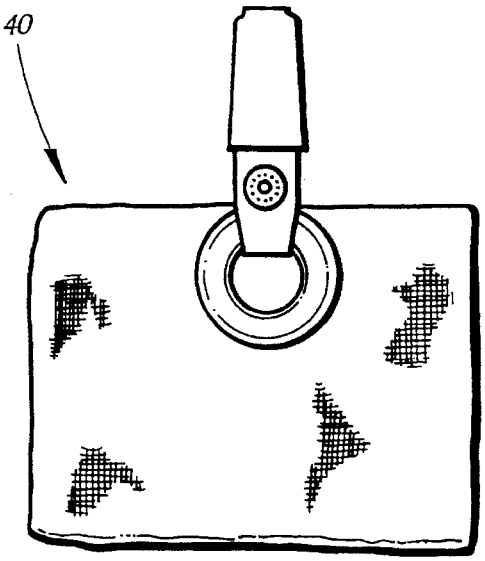
FIG. 7 is a front elevation of a weight assembly according to a third preferred embodiment.
Figure 8:
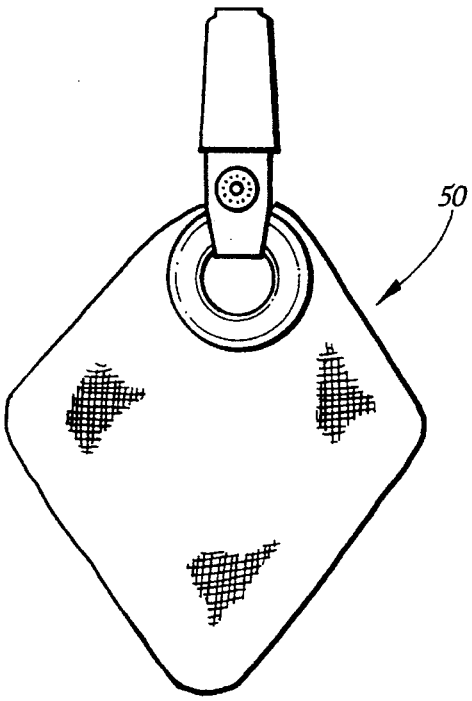
FIG. 8 is a front elevation of a weight assembly according to a fourth preferred embodiment.

FIGS. 6, 7, and 8, illustrate alternative embodiments of the weight assembly 10. The weight assembly 30 of FIG. 6 is circular. The weight assembly 40 of FIG. 7 is square-shaped, and the weight assembly 50 of FIG. 8 is diamond-shaped. Notwithstanding the various shapes, the weight assemblies 30, 40, and 50, are identical to that described above.

A detachable weight assembly, and cover used in combination with a detachable weight assembly are described above. Various details of the invention may be changed without departing from its scope. Furthermore, the foregoing description of the preferred embodiment of the invention is provided for the purpose of illustration only and not for the purpose of limitation—the invention being defined by the claims.

We claim:

1. A detachable weight assembly for holding a cover in a desired position solely by gravity, said weight assembly comprising:

(a) a water-permeable weight bag filled with sand, said weight bag being sufficiently heavy to immobilize the cover by gravity;

(b) a grommet attached to said weight bag, and defining a reinforced opening therein; and (c) a fastener comprising an elongate flexible strip and a spring-loaded clip connected to said strip for removably attaching the weight bag to the cover, said strip including a free end thereof for being passed through said grommet and complementary snap means for releasably securing said fastener to said weight bag.

2. A detachable weight assembly according to claim 1, wherein said weight bag contains between 4–8 oz. of dry sand.

3. A detachable weight assembly according to claim 1, wherein said weight bag is triangular with said fastener being secured at one corner thereof.

4. A detachable weight assembly according to claim 1, wherein said weight bag is square.

5. A detachable weight assembly according to claim 1, wherein said weight bag is diamond-shaped.

6. A detachable weight assembly according to claim 1, wherein said weight bag is circular.

7. In combination with a cover, a plurality of weight assemblies removably attached in spaced-apart relation along the perimeter edges of the cover for holding the cover in a desired position solely by gravity, said weight assembly comprising:

(a) a water-permeable weight bag filled with sand, said weight bag being sufficiently heavy to immobilize the cover by gravity;

(b) a grommet attached to said weight bag, and defining a reinforced opening therein; and (c) a fastener comprising an elongate flexible strip and a spring-loaded clip connected to said strip for removably attaching the weight bag to the cover, said strip including a free end thereof for being passed through said grommet and complementary snap means for releasably securing said fastener to said weight bag.

8. A combination according to claim 7, wherein said cover is a beach towel for being spread out on the beach or over a lounge chair.

9. A combination according to claim 7, wherein said cover is a protective, equipment cover.

* * * * *